US008074325B2

(12) United States Patent
Gerfast

(10) Patent No.: US 8,074,325 B2
(45) Date of Patent: Dec. 13, 2011

(54) CLIP-TYPE LABEL

(76) Inventor: Sten R. Gerfast, Mendota Heights, MN (US)

( * ) Notice: Subject to any disclaimer, the term of this patent is extended or adjusted under 35 U.S.C. 154(b) by 285 days.

(21) Appl. No.: 11/172,026

(22) Filed: Jul. 1, 2005

(65) Prior Publication Data

US 2007/0000099 A1 Jan. 4, 2007

(51) Int. Cl.

| | |
|---|---|
| ***B42F 1/02*** | (2006.01) |
| ***B42F 1/12*** | (2006.01) |
| ***B42F 21/06*** | (2006.01) |
| ***G09F 3/08*** | (2006.01) |
| *G09F 3/16* | (2006.01) |
| *G09F 23/00* | (2006.01) |

(52) U.S. Cl. ..... 24/67.9; 24/67 R; 40/641

(58) Field of Classification Search ..... 24/67.9, 24/67.3, 67 AR, 67, 11, 30.5 W, 30.5 S; 40/359, 40/360, 641, 674

See application file for complete search history.

(56) References Cited

U.S. PATENT DOCUMENTS

| | | | | | |
|---|---|---|---|---|---|
| 785,911 | A * | 3/1905 | Nold | 402/15 |
| 2,341,121 | A * | 2/1944 | Schaaff | 24/561 |
| 2,768,416 | A * | 10/1956 | McMullen | 24/67.9 |
| 2,938,252 | A * | 5/1960 | Scheemaeker | 24/67.9 |
| 3,164,250 | A * | 1/1965 | Paxton | 24/30.5 S |
| 3,296,673 | A * | 1/1967 | Kirkpatrick | 24/265 A |
| 3,673,641 | A * | 7/1972 | Lorber | 24/67.9 |
| 3,798,713 | A * | 3/1974 | Lakos | 24/90.5 |
| 4,011,673 | A * | 3/1977 | Levine | 40/641 |
| 4,790,680 | A * | 12/1988 | Givati et al. | 402/68 |
| 5,214,825 | A * | 6/1993 | Hirzel | 24/67.9 |
| 5,357,653 | A * | 10/1994 | van Ardenne | 24/67.9 |
| 5,495,644 | A * | 3/1996 | Mesher et al. | 24/3.12 |
| 5,519,976 | A * | 5/1996 | Gee | 52/712 |
| 6,973,700 | B2 * | 12/2005 | Hsiao | 24/67.9 |
| 2005/0150084 | A1 * | 7/2005 | Dreyer | 24/67.9 |

* cited by examiner

*Primary Examiner* — Robert Sandy

(57) ABSTRACT

This is a unique, yet simple clip that also serves as a label for identification. It can be attached to a bundle of papers or on a file folder. It can also have adhesives for such attachment either on a permanent or removable basis. It can be used either in an office environment or in a home and can have a writable surface as well as having several embossed alpha-numeric or Braille characters.

17 Claims, 1 Drawing Sheet

CLIP-TYPE LABEL

TECHNICAL FIELD

Figure 1:
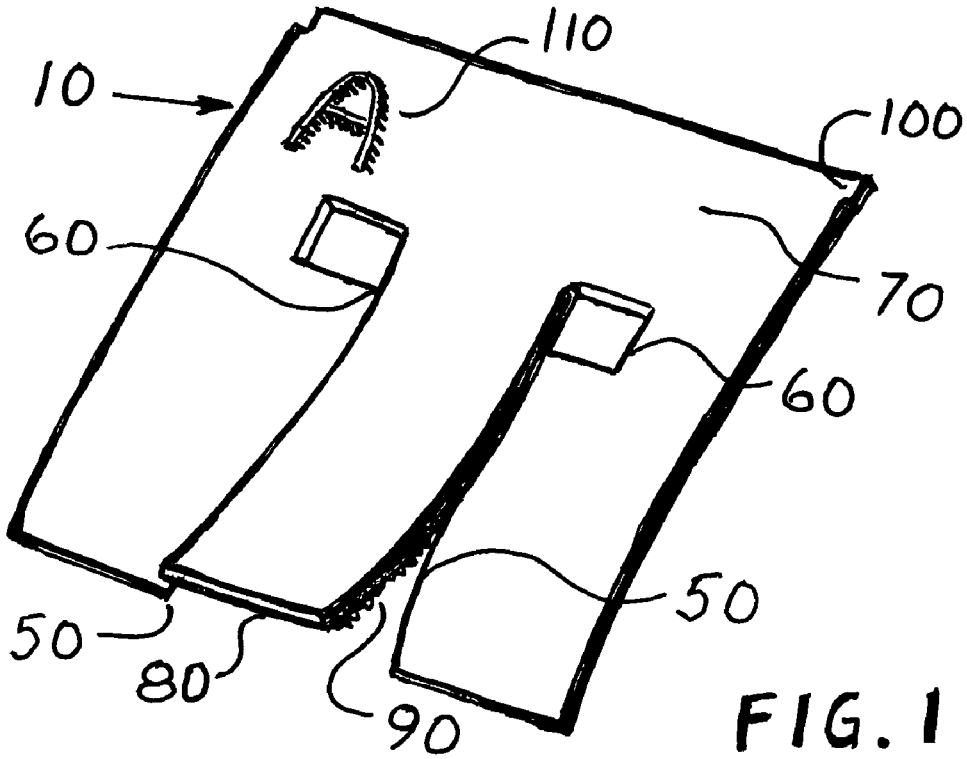

This invention relates to clip-type labels for paper or paper folders. It has a section with a pre-printed, embossed or writable area on the top of the clip. This type of clip can have a pressure sensitive adhesive on some of its surfaces for permanent placement, or a low tack adhesive as a re-positioning type clip.

In its simplest form it has no adhesive, and it is used to hold a few pages of paper or files together.

BACKGROUND OF THE INVENTION

Labels for files in filing drawers have been on the market for many years. They have been fabricated by metal or plastic for attachment to the top of the file folder by different methods. Some of the used methods have been cardboard labels that are inserted into riveted holders on top of the folder, or clear plastic tabs that are inserted into slots in the folders. Manila folders with top extensions for writing (describing the contents of the folder) is in common use Regular paper clips in many different forms are used for holding paper sheets together. The majority of paper clip designs do not have any methods to indicate what is included in the bundle. Pre-printed single sheet film labels, that are adhesive coated, are also on the market. They can be attached to the top sheet of a bundle of papers.

These labels are quite flimsy and need a paper clip to have the papers in the bundle hang together.

THE PRESENT INVENTION

The present invention is a clip holding a bundle of papers together that also indicates what is in the bundle.

It serves as both a label, that is writeable, printable or embossable, and as a paper clip holding a stack of paper together.

This clip solves the above mentioned shortcomings in office or everyday home environment.

It is punched out from a flat sheet having a plurality of sheared fingers that hold the paper sheets.

With "punched out" is meant an outline cut made by a die cutting the flat material.

This is generally referred to as a stamping process. It can have a so-called "male-female die set" or a "steel rule die".

The word "shear" is meaning a shearing similar to a scissors cut.

This stamping process is one the best and most economical ways to manufacture parts from material in sheet form.

Each single stroke of the press can make a whole string of label clips.

The cost to produce these label clips is generally less than the related art formed "spring wire" paper clips yet the present invention's label clip has many more functions.

Additionally, without added parts cost, each label clip can be embossed or imprinted at the same punch-out stroke.

It could be described as:

A substantially flat label clip comprising:

a flat square sheet with one edge having a plurality of shears, each shear terminating at a square cut out, leaving the opposite edge uncut, producing a label clip with a plurality of fingers.

During the punch operation two adjacent fingers can also be formed or bent with opposite curvature that aids in the assembly of the clip onto a paper edge. The mentioned holes, or cut outs, aids in the retention, or holding together, of a bundle of paper sheets. The shearing or punching can also be done with a purposely done "burred' edge that also would be helpful in retaining the clip in place. The fingers can have different lengths.

The uncut edge serves as an area for identification that consist of either:

A Written with pen or a felt-tip pen or B Pre-printed with alpha numeric characters C Embossed into the sheet with alphanumeric characters D Embossed into the sheet with Braille characters Advertising, either by printing or embossing The material in sheet form can be plastic, hard cardboard stock or metal. The sheet stock could also be interleaved with strips coated with pressure sensitive adhesive on a release liner. The release liner could be beneficial in keeping a multitude of label clips in strip form for easy packaging. If the label clips are punched from a strip stock, with a small "remnant" between each label clip, the whole strip would "hang together", again facilitating packaging. The label clips instead of being square (or rectangular) could have rounded or chamfered corner both in the area of edges and fingers. If the label clip is sheared with three fingers and the middle finger is shorter than the two outside fingers it also aids in the attachment of the label clip to a paper edge. A matte finish raw material also aids in holding.

In a filing system it is very helpful to have differing "sections" marked with different colors.

The label clip of this invention can be produced with color identification in all the materials mentioned above.

It could also be described as:

A single stroke punchable label clip comprising:

a flat square sheet with one edge having at least two shears, each shear terminating at a square cut out, leaving the opposite edge uncut, producing a label and clip combination with a plurality of radiussed fingers.

The uncut edge serves as an excellent label area that, if not pre-printed or pre-embossed, can be written on with pens or pencils. If the raw material was having a matte surface finish the writing could be done more easily. Embossing or raising alpha-numeric characters out of the raw material can also be done by the die at the same time that the outline is punched out. The raised characters can have many different forms.

If the raised characters are Braille characters this invention can be used booth by blind persons at their homes as well as giving them employment of filing in an office environment.

The descriptions of the present invention that are mentioned above are by no means conclusive of how the invention can be used or manufactured. A person skilled in the art could easily make many different modification or uses for this invention.

DETAILED DESRIPTION OF THE DRAWING

In FIG. 1. is shown a label clip of the present invention 10 with dual shears 50 at one edge terminating at square cut outs 60, leaving the opposite edge 70 uncut for labeling purposes. Also shown is the natural curvature 80, close to the shear 50, that could be produced with a die that is purposely doing a "burred' edge 90. On the uncut edge 70 is shown a remnant 100. An embossed character 110 is also shown on the uncut edge 70.

Figure 2:
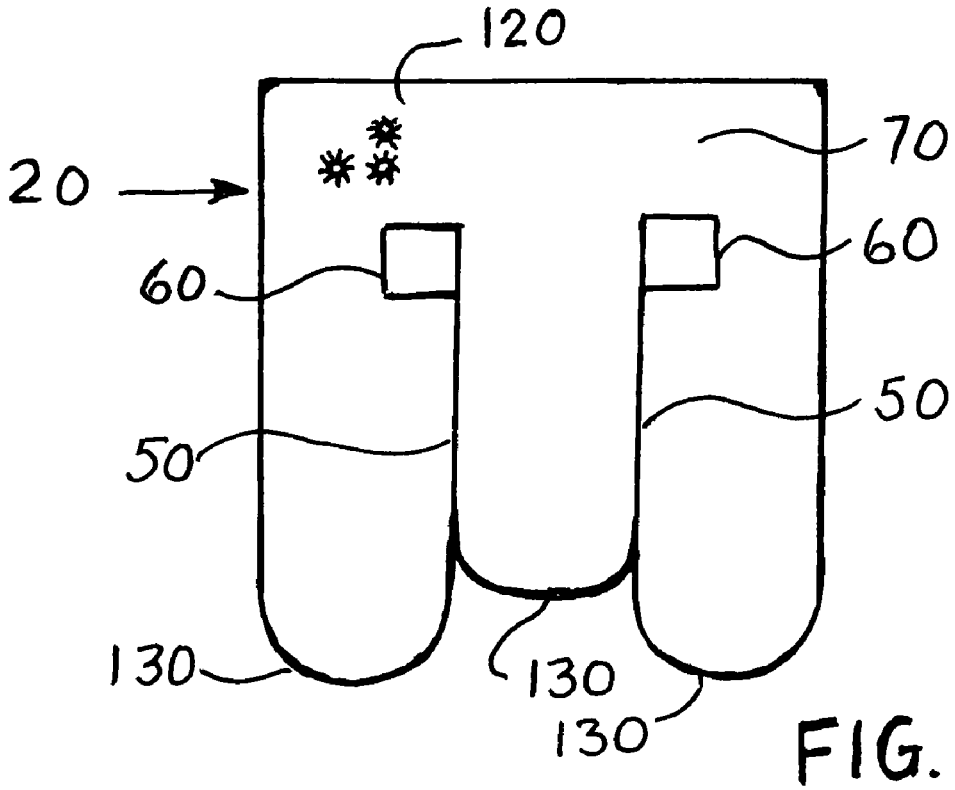

FIG. 2. shows a label clip of the present invention 20 with dual shears 50 terminating at square cut outs 60, leaving the opposite edge 70 uncut for labeling purposes. On the uncut edge 70 is also shown an embossed Braille identification mark 120. Also shown are radiussed fingers 130.

I claim:

1. A substantially flat label clip comprising:

a substantially flat sheet with a substantially flat edge portion, and another edge portion having a plurality of shears each terminating at a square cutout, producing a label clip with three fingers, the three fingers including a middle finger and two adjacent fingers, the middle finger having a curvature extending away from a plane defining the substantially flat edge portion and the two adjacent fingers have an opposite curvature to the middle finger and extending away from the plane defining the substantially flat edge portion of the sheet.

2. A label clip of claim 1 wherein said uncut edge portion is suitable for writing, pre-printing or embossing.

3. A label clip of claim 1 wherein each of said fingers are partly coated with pressure sensitive adhesive.

4. A label clip of claim 1 wherein each of said fingers are partly coated with low tack adhesive.

5. A label clip of claim 1 wherein each of said shears have burred edges.

6. A label clip of claim 1, wherein said flat square sheet is metal and the edge portion having the plurality of shears includes burred edges.

7. A substantially flat label clip comprising:

a substantially flat square sheet with one edge portion having a plurality of shears, each shear terminating at a square cutout leaving a substantially flat opposite edge portion of the sheet uncut, producing a label clip with three fingers, the three finger including a middle finger and two fingers being adjacent to the middle finger, the middle finger having a curvature extending away from a plane defining the substantially flat opposite edge portion of the sheet and the two adjacent fingers each having an opposite curvature to the middle finger and extending away from the plane defining the opposite edge portion of the sheet.

8. A single stroke punchable label clip comprising:

a flat substantially square sheet with one edge portion having at least two shears, each shear terminating at a square cutout leaving a substantially flat opposite edge portion uncut, producing a label and clip combination with a plurality of radiussed fingers, wherein said plurality of fingers include three fingers, the three fingers being a middle finger having a curvature extending away from a plane defining the substantial flat edge portion of the sheet and two adjacent fingers each having an opposite curvature to the middle finger and extending away from the plane defining the opposite edge portion of the sheet.

9. A label clip of claim 8 wherein said uncut edge portion is suitable for writing, pre-printing or embossing.

10. A label clip of claim 8 wherein each of said fingers are partly coated with pressure sensitive adhesive.

11. A label clip of claim 8 wherein each of said fingers are partly coated with low tack adhesive.

12. A label clip of claim 8 wherein each of said shears have burred edges.

13. A label clip of claim 8, wherein the label clip is produced from a matte finish flat sheet.

14. A label clip of claim 8 wherein each of said fingers are produce in different lengths.

15. A label of claim 8 wherein said single stroke punchable label is formed by punching, which embosses to form and print said label clip.

16. A label clip of claim 8 wherein said label clip is punched from a strip-form including a plurality of label clips each held together with a remnant between each label clip formed on the strip-form.

17. A label clip of claim 8 wherein said uncut edge portion includes embossed Braille characters or embossed or printed alpha-numeric characters.

* * * * *